US006287133B1

(12) United States Patent
Yang

(10) Patent No.: US 6,287,133 B1
(45) Date of Patent: Sep. 11, 2001

(54) DUSTPROOF COVER

(75) Inventor: Wins Y. W. Yang, Taipei Hsien (TW)

(73) Assignee: Ming Fortune Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 09/521,055

(22) Filed: Mar. 8, 2000

(51) Int. Cl.[7] ..... H01R 13/44
(52) U.S. Cl. ..... 439/138
(58) Field of Search ..... 439/135, 136, 439/140, 142, 149

(56) References Cited

U.S. PATENT DOCUMENTS 4,217,019 * 8/1980 Cameron ..... 439/138
4,556,264 * 12/1985 Tanaka ..... 439/62
5,224,868 * 7/1993 Tseng ..... 439/136

FOREIGN PATENT DOCUMENTS

0232792 * 8/1987 (DE) .
12-100514 * 4/2000 (JP) .

* cited by examiner

*Primary Examiner*—Khiem Nguyen
*Assistant Examiner*—Michael C. Zarroli
(74) *Attorney, Agent, or Firm*—Jiawei Huang; J.C. Patents

(57) ABSTRACT

A dustproof cover installed in a connector comprises a connector body and a terminal. The connector body includes a substantially cubic shape receiving space which is formed of a bottom side, an opposite top side, a rear side, and two lateral sides. The two lateral sides each has recess near a junction of the opening and the top side, and the terminal is installed on the bottom side. The dustproof cover is installed at the front opening of the receiving space and comprises a U-shaped body, which includes a bottom plate and two lateral plates, with the concave side forming a slot. Two extension plates are respectively located along the edges of the two lateral plates and extended away from the U-shaped body, with the extension plate and the lateral plate forms a L-shaped structure. Two extruded pivots, pointing away from the U-shaped body, are respectively located on the two lateral plates near one end of the U-shaped body, to be secured in the two recesses of the connector body. Two protrusions are respectively located at the concave sides of the U-shaped body and the junctions between the bottom plate and the two lateral plates. A spring is located at the extruded pivot with one end against the top side of the connector body and the other end against one of the two extension plates.

7 Claims, 9 Drawing Sheets

(a)

(b)

(b)

(a)

DUSTPROOF COVER

CROSS-REFERENCE TO RELATED APPLICATION

This application claims the priority benefit of Taiwan application serial no. 88213293, filed Aug. 6, 1999.

BACKGROUND OF THE INVENTION

1. Field of Invention

The present invention relates to a dustproof cover for a connector, in particular, relates to a kind of dustproof cover which is installed in the connector and protects the terminal from contamination.

2. Description of the Prior Art

Computer technology is flourishing and networked systems are currently a very popular technology for information transfer and exchange. In addition to increase the speed of information transfer, how to insure the quality of the transfer is a serious issue nowadays. In general, network connections constitute transfer media, connectors, and so on. Transfer media may be a twisted pair, coaxial cable, optical fiber, microwave, etc. Currently, the most popular one is the unshield twist pair (UTP), which includes those used by personal network connections such as the telephone line or the modem, or general network line.

Because of the linkage requirement of the network, connectors that are used for linkages between signal lines become some of the important parts. Connectors can be constructed in many different types in order to adapt to so many different transfer media such as the network line connector, coaxial cable connector, telephone line connector, optical fiber connector and so on. In real practice, a few connectors are usually neatly aligned and placed in the corner of a room in a wiring frame manner, and then connected to the network lines. Connectors are commonly female in type, which facilitates signal line connections. When a commodity has to make a connection to the network, a signal line plug of the commodity, which is male, is linked to the connector. This finishes the signal line linkage operation.

Reference is made to FIG. 1, which illustrates a typical type of connector. As is well known, a typical connector is usually female, as shown in FIG. 1. Reference can be made to Taiwan New Type Pattern No. 275977, "A Connector and the Extended Exchange Device of the Connector's Assembles" (filed Oct. 12, 1995); or New Type Pattern No. 359421, "A Connector" (filed Jan. 1, 1998) of the present inventor. As the connector 10 is female, it has an opening 12. A naked terminal 14 is installed inside and functions as one side of the terminal during linkage with the male connector. When designing an interior space, due to delicacy, wiring convenience and/or other reasons, the wiring frame is usually placed the corner of a room or some other inconspicuous location. Since dust easily accumulates in the corner of a room, the terminal side of the connector is likely to be contaminated before making linkage to the plug. After a long period of time, linkage made between the connector and the plug is likely to have a rough contact and other problems are likely to exist between them.

SUMMARY OF THE INVENTION

The present inventor has disclosed a dustproof cover that is adapted to all different types of connectors on Jan. 15, 1998 in a Taiwan New Type Pattern Application (Application Serial No. 87200668) in which the dustproof cover is placed on the outside surface of a connector.

The present invention provides a dustproof cover installed in a connector. The connector comprises a connector body and a terminal. The connector body includes a substantially cubic shape receiving space with a front opening. A bottom side, an opposite top side, a rear side, and two lateral sides form the receiving space. The two lateral sides have respective recesses located near a junction of the front opening and the top side, and the terminal is installed on the bottom side. The dustproof cover is installed at the front opening of the receiving space, and comprises a U-shaped body which includes a bottom plate and two lateral plates. The concave side of the U-shaped body forms a slot. Two extension plates are respectively located along the edges of the two lateral plates and extended away from the U-shaped body such that the extension plate and the lateral plate forms a L-shaped structure. Two extruded pivots, pointing away from the U-shaped body, are respectively located on the two lateral plates near one end of the U-shaped body, to be secured in the two recesses of the connector body. Two protrusions are located in the concave side of the U-shaped body and respectively at the junctions between the bottom plate and the two lateral plates in order to buckle a signal line plug. Additionally, two springs are respectively located at the extruded pivots, with one end of it against the top side of the connector body and the other end against one of the two extension plates. Thus, a moment is applied to the dustproof cover by the spring so that the dustproof cover is urged to rotate toward the front opening of the connector body.

BRIEF DESCRIPTION OF THE DRAWINGS

The above and other objects, features and other advantages of the present invention will be more clearly understood from the following preferred embodiment of the present invention taken in conjunction with the accompanying drawings, in which.

DESCRIPTION OF THE PREFERRED EMBODIMENTS

Figure 1:
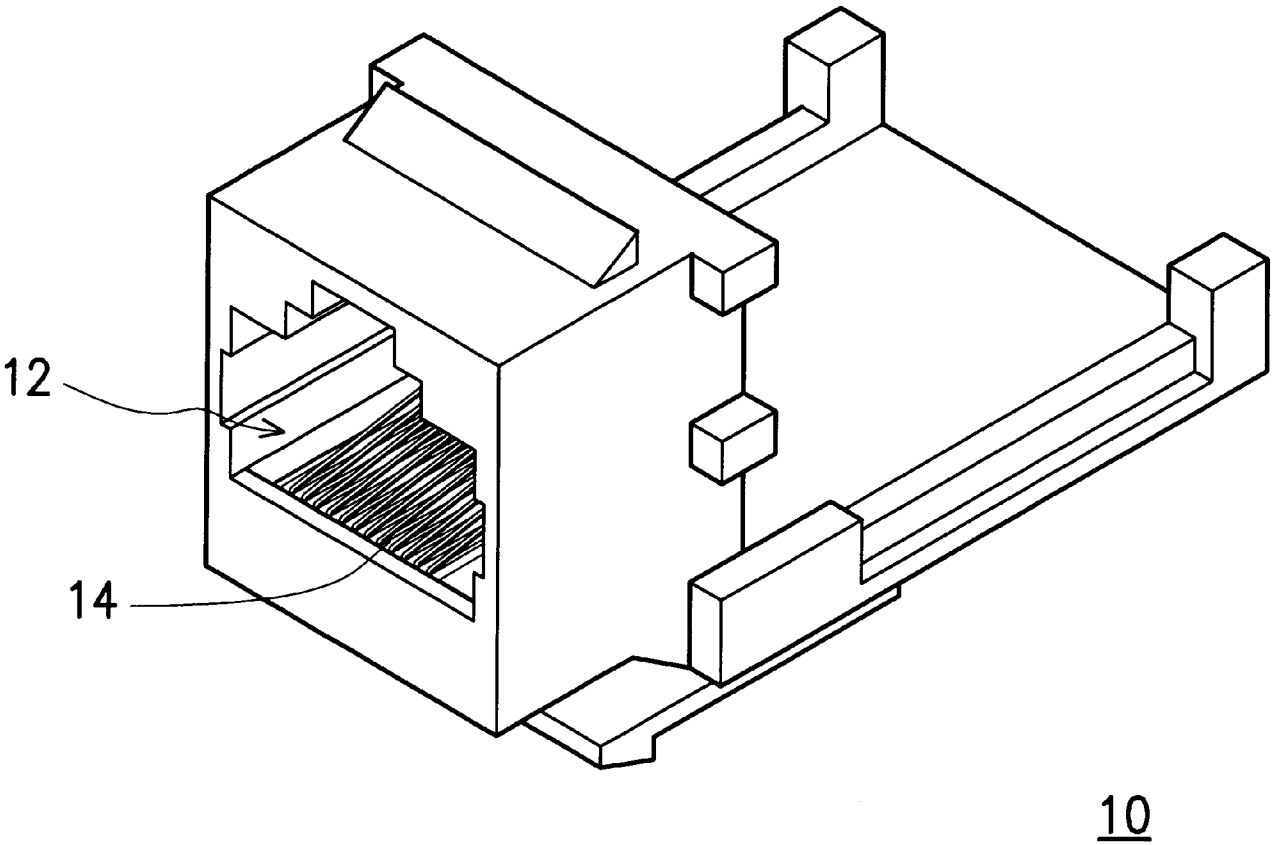
FIG. 1 (PRIOR ART)
FIG. 1 is an illustration of a typical connector.
Figure 2A:
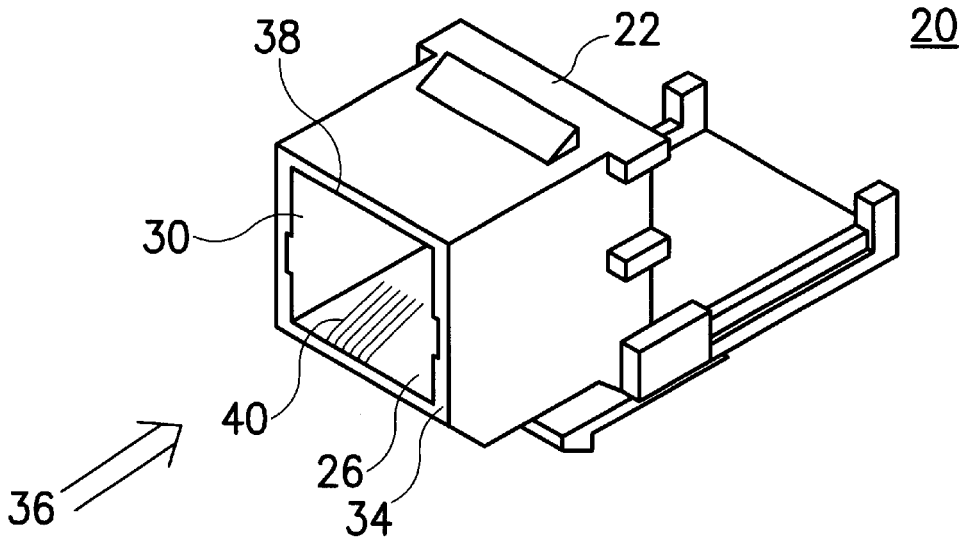
FIGS. 2A and 2B are perspective views of a connector suitable for the installation of the dustproof cover in accordance with a preferred embodiment of the present invention.
Figure 2B:
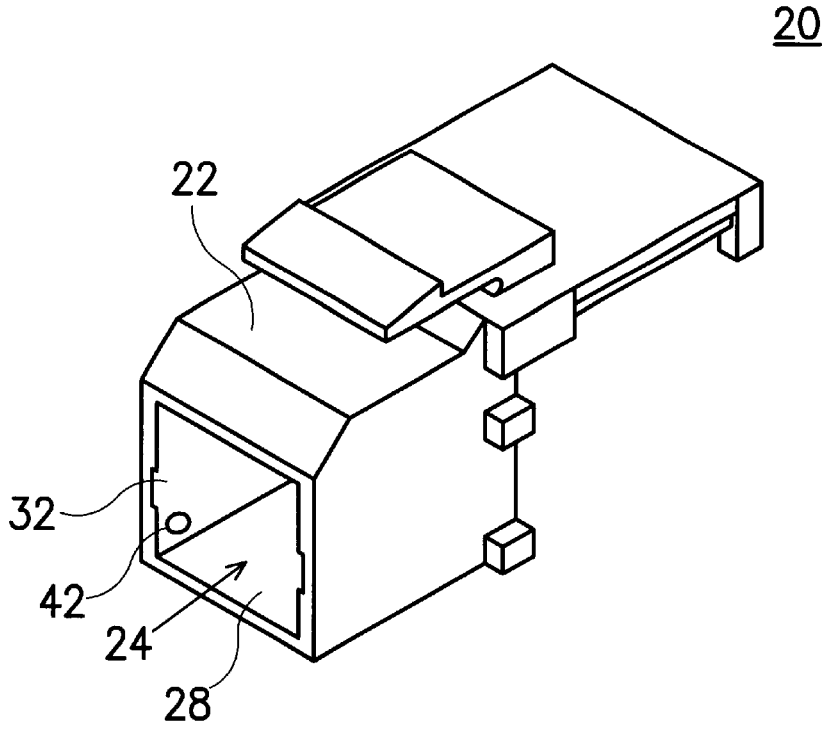

FIG. 2A and FIG. 2B are perspective views of a connector which is adapted for the installation of a dustproof cover in accordance with a preferred embodiment of the present invention. FIGS. 2A and 2B illustrate two perspective views of the connector from different directions. The connector 20 constitutes a connector body 22 with a receiving space 24 therein. The receiving space 24 is made of a bottom side 26, a top side 28 and two lateral sides 30, 32. The surface 34 of one end of the connector body 22 (as illustrated by the arrow 36) forms a front opening 38 which connects with the receiving space 24. A signal line plug is inserted through the opening 38 into the receiving space 24. The types of signal line plug suitable for the connector of the present invention include: RJ-45, a general network line plug; RJ-11, a general telephone line or modem line; and other similar types of plugs. A terminal 40, which is in electrical contact with the signal line plug, is located on the bottom side 26 of the receiving space 24. The two lateral sides 30, 32 have recesses 42 respectively located near the junctions of the opening 38 and the top side 28, which are used for the installation of the dustproof cover.

Figure 3A:
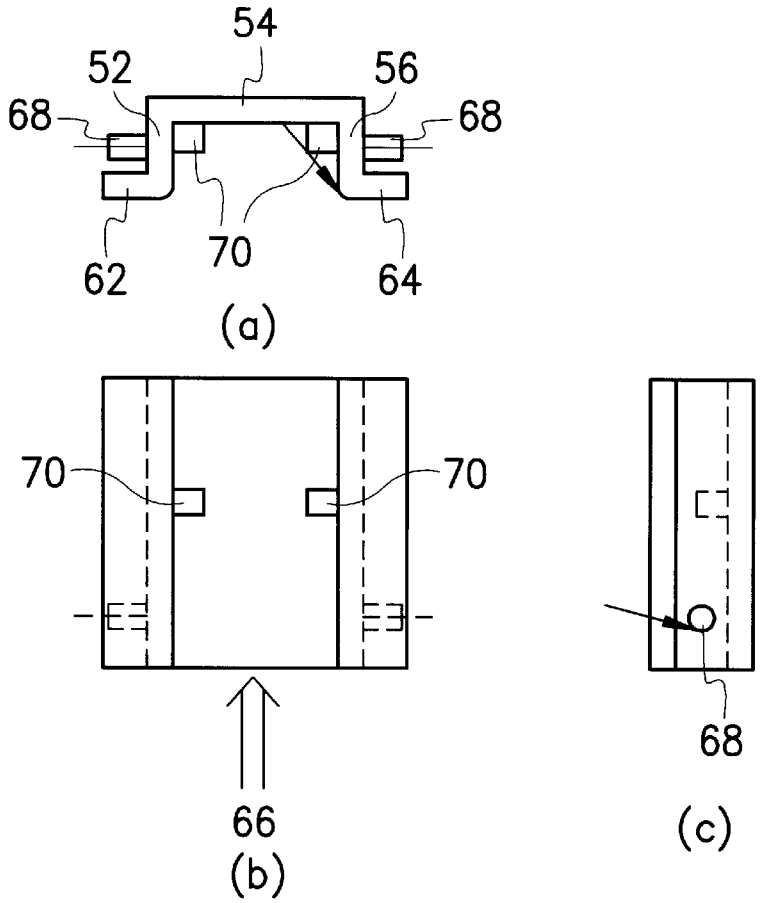
FIG. 3A illustrates three sideviews of the dustproof cover.
Figure 3B:
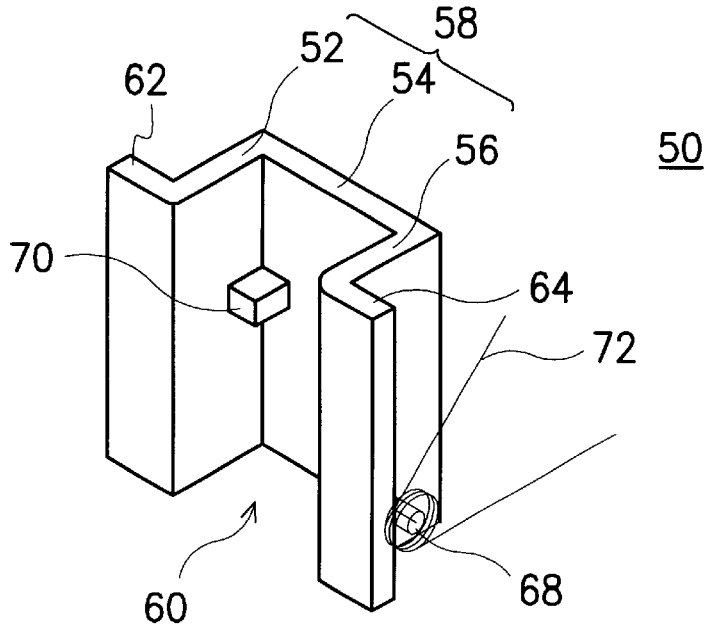
FIG. 3B illustrates a perspective view of the dustproof cover.

Reference is made to FIGS. 3A and 3B, wherein FIG. 3A presents three sideviews of the dustproof cover and FIG. 3B shows a perspective view of the dustproof cover. The dustproof cover 50 mainly constitutes a U-shaped body 58 which is composed of a bottom plate 54 and two lateral plates 52, 56. The concave side of the U-shaped body 58 forms a slot 60 which allows the signal line plug to slide in. There are two extension plates 62, 64 located along edges of the two lateral plates 52, 56 of the U-shaped body 58, respectively, and extended away from the U-shaped body 58. The two extension plates 62, 64 and the two lateral plates 52, 56 form L-shaped structures, respectively. Moreover, the two lateral plates 52, 56 each have an extruded pivot 68 near one end of the U-shaped body 58 (as indicated by the arrow 66). The extruded pivots 68 are secured in the recesses 42 of the connector (20 of FIGS. 2A, 2B) during the installation, and also function as rotating pivots for the dustproof cover 50 after installation. Furthermore, there are two protrusions 70 located on the concave side of the slot 60 of the U-shaped body 58 and respectively at the junctions of the bottom plate 54 and the two lateral plates 52, 56. When a signal line plug inserts into the connector along the slot 60, the two protrusions 70 can buckle the signal line plug. This ensures a tight contact between the signal line plug and the terminal, and the contact is unlikely to loosen. During the installation, each of the extruded pivots 68 receive a spring 72, one end of which resists the lateral plate 62, 64 and the other end of which resists the top side 28 of the connector 20 (see FIGS. 2A, 2B) such that the dustproof cover 50 remains at the opening 38 of the connector 20.

Figure 4A:
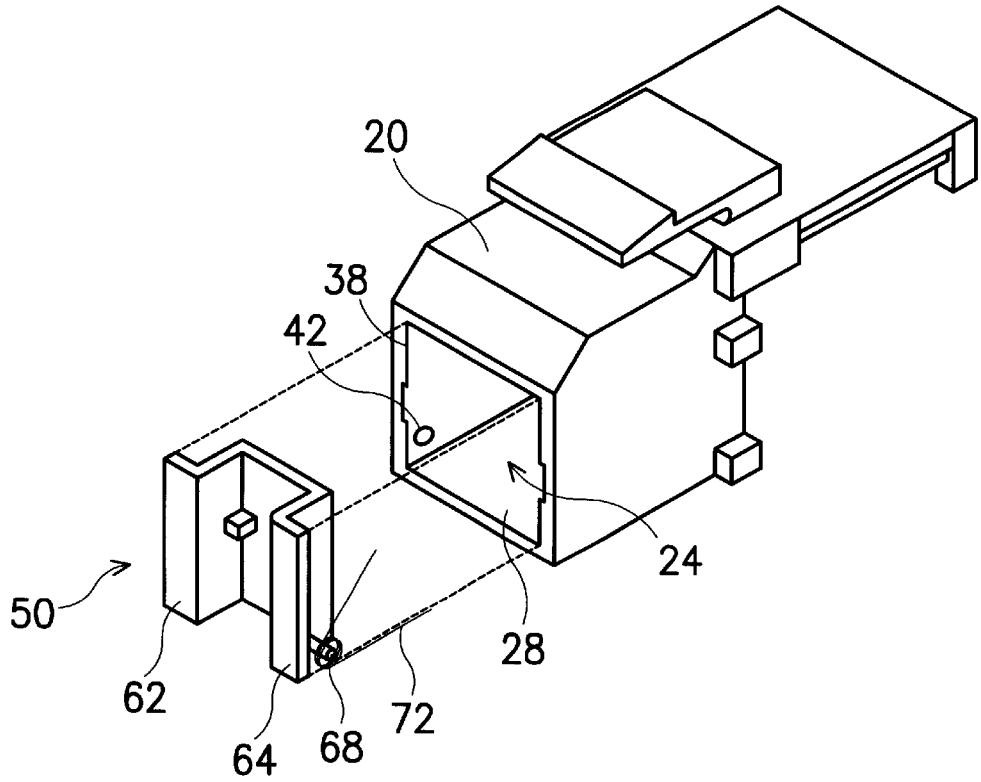
FIG. 4A is an exploded perspective view of the dustproof cover of the present invention and the connector.
Figure 4B:
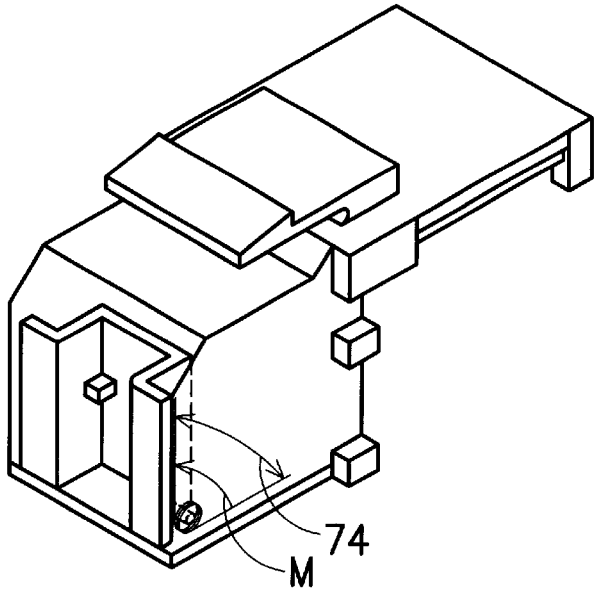
FIG. 4B is a perspective view of the dustproof cover of the present invention and the connector.

Reference is made to FIGS. 4A and 4B, wherein FIG. 4A shows an exploded view of the dustproof cover of the present invention and the connector, and FIG. 4B illustrates a perspective view of the combination of the dustproof cover of the present invention and the connector. During installation, the dustproof cover 50 together with the springs 72 are installed in the receiving space 24 of the connector 20 as the extruded pivots 68 secured to the corresponding recesses 42. At this time, the dustproof cover 50 can be pivoted between the top side 28 and the opening 38 of the connector 20 (as illustrated by the double arrow 74) about the extruded pivots 68. Since the springs 72 resist the top side 28 and the two lateral plates 62, 64, a moment M is initiated against the dustproof cover 50 by the springs 72, which moment M urges the dustproof cover 50 to rotate toward the opening 38.

Figure 5:
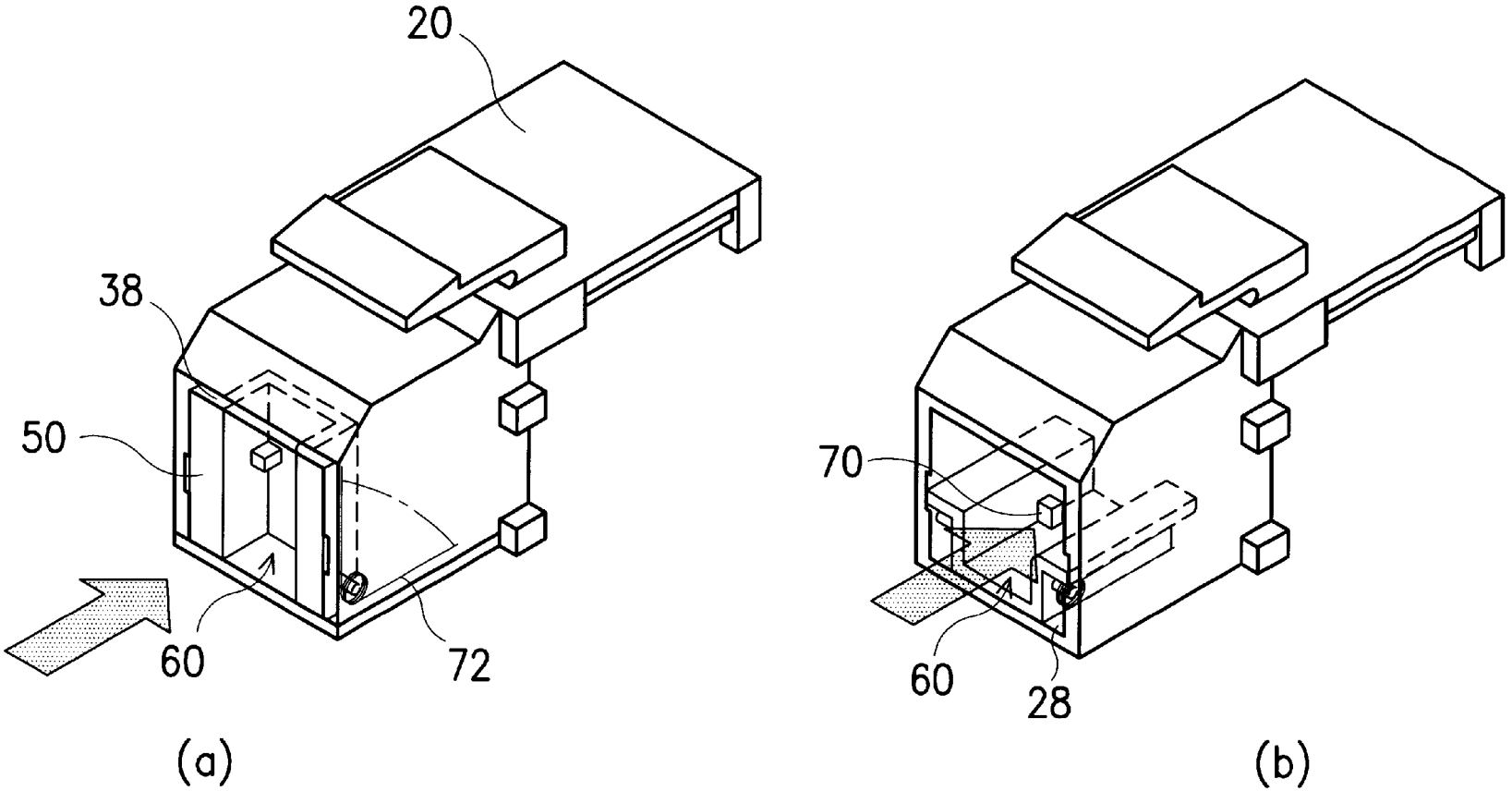
FIG. 5 is a view showing the operation of the connector with the dustproof cover.

Reference is made to FIG. 5, which shows the operation of a connector with a dustproof cover. When a signal line plug has not yet been inserted into the connector 20, due to the action of the moment M, the dustproof cover 50 is located at the opening 38 of the connector. This shields the opening 38 and prevents dust or other contaminating objects from entering the receiving space. At this time, the slot 60 of the dustproof cover 50 faces outward of the opening 38. When there is an insertion of a signal line plug, the slot 60 of the dustproof cover 50 is parallel to the top side 28. This allows the entrance of the signal line plug into the receiving space by sliding along the slot 60, and the signal line plug makes contact with the terminal to form an electrical connection. Also, the protrusions 70 buckle the signal line plug to make sure that there is a tight contact between the signal line plug and the terminal without any possible loosening in between, which ensures the continuation of information transfer.

Figure 6:
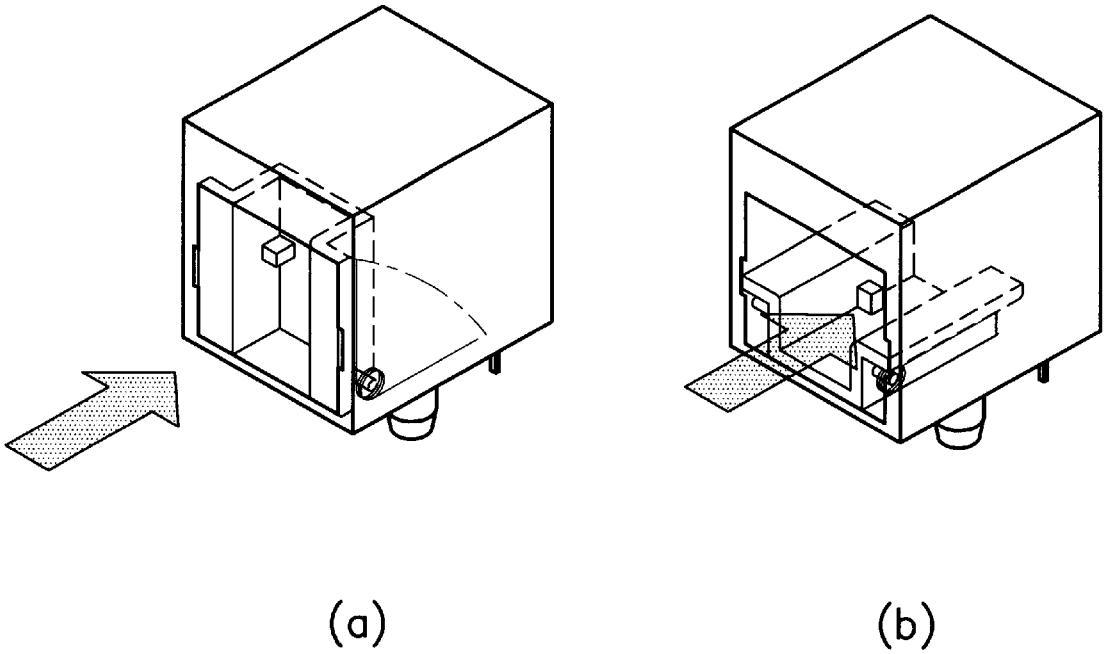
FIGS. 6 to 9 illustrate the applications of the dustproof cover of the present invention with different types of connectors.
Figure 7:
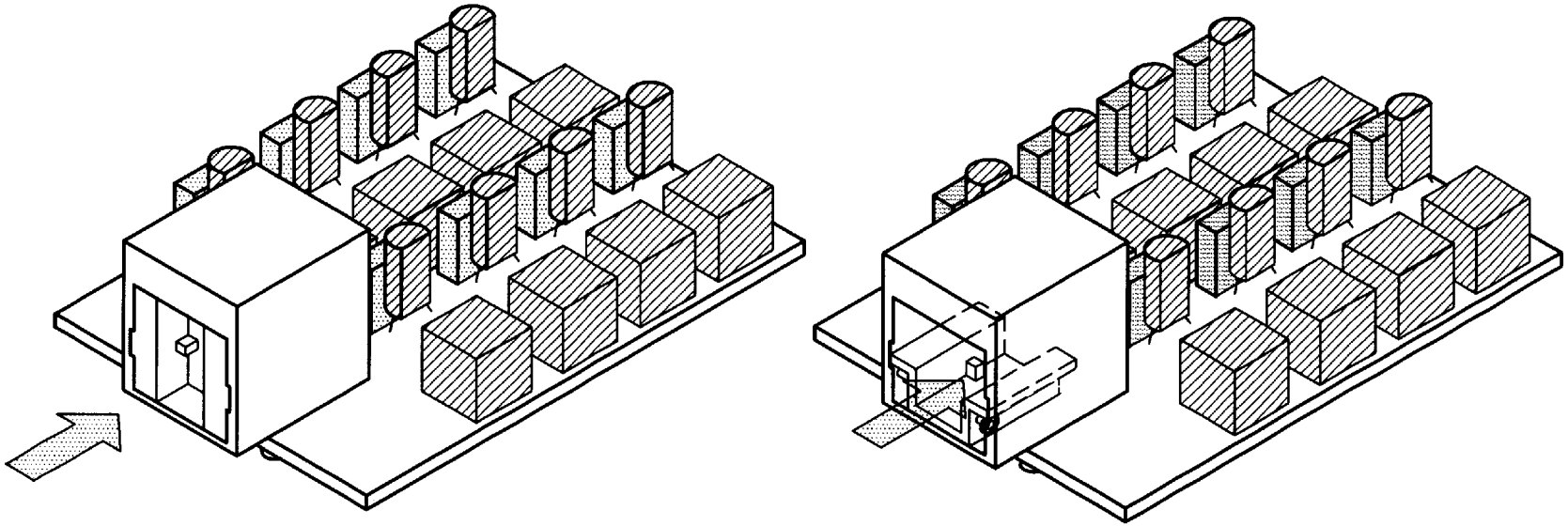
Figure 8:
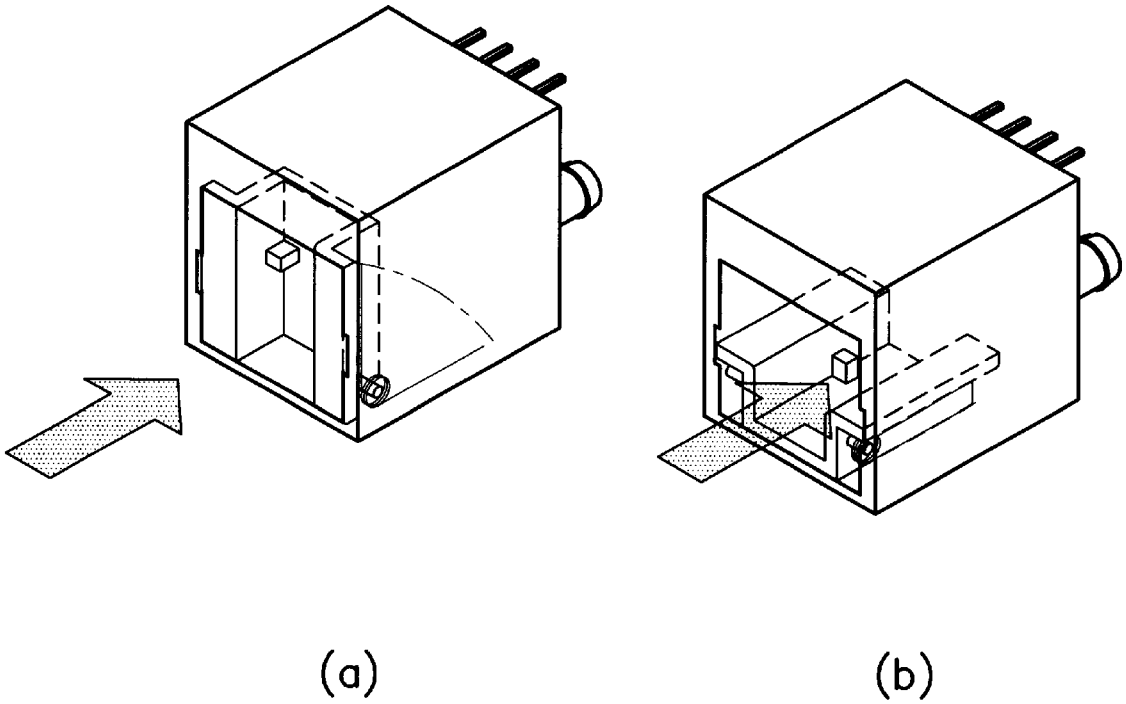
Figure 9:
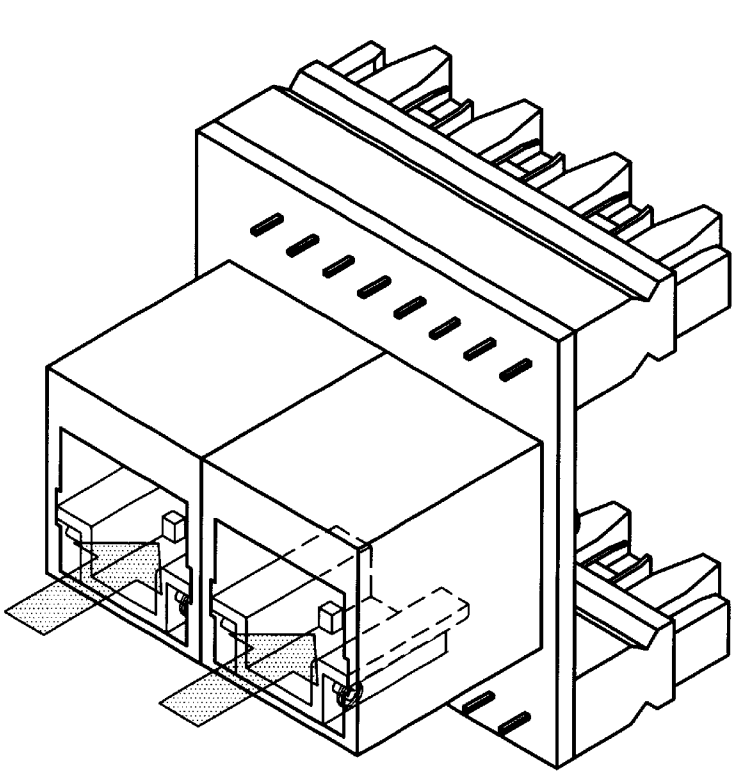
Figure 9:
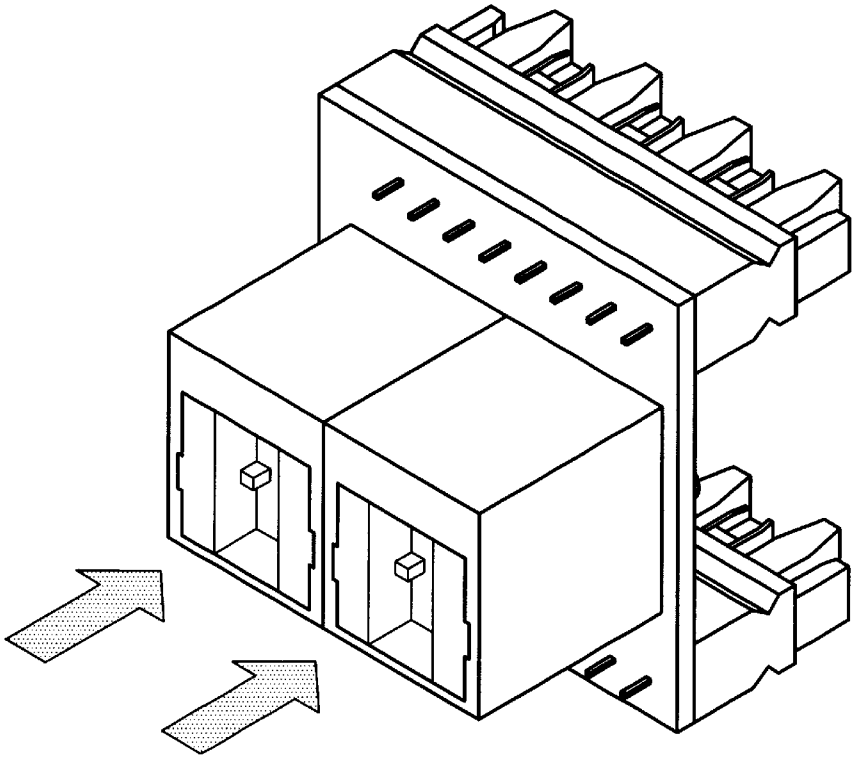

Reference is made to FIG. 6 to FIG. 9, which show the dustproof cover of the present invention applied to different types of connectors. FIG. 6 illustrates a type of connector with the outgoing signal line coming out at the bottom side of the connector. FIG. 7 shows a type of connector which is used in a printed circuit board. FIG. 8 illustrates a type of connector with the outgoing signal line coming out at the rear side of the connector. FIG. 9 shows a panel type of connectors. The present invention is not only applicable to those types of connectors disclosed in: Taiwan New Type Pattern No. 275977 "A Connector and the Extended Exchange Device of the Connector's Assemblies" (filed date, Oct. 12, 1995); or New Type Pattern No. 359421 "A Connector" (filed date, Jan. 15, 1998) of the present inventor. It can also be combined with those piling frame types panel connectors disclosed in: Taiwan New Type Pattern No. 138921 "A Piling Frame Type Layout Panel" (filed date, Apr. 22, 1997); or New Type Pattern No. 137723 "A Layout Panel" (filed date, Sep. 19, 1997) of the same present inventor. As long as those connectors are used for the RJ-45 network line's plug, the RJ-11 telephone line's plug or other similar types of plugs, they can all be employed the dustproof cover of the present invention.

As described above, the present invention can be installed inside of many types of connectors, and prevents exposure of the terminal of the connector to the outside and contamination. Also, the invention does not require any additional space for installation of the dustproof cover of the present invention, and hence insures the quality of the connector.

Although the preferred embodiment of the present invention has been disclosed for illustrative purposes, it is not intended to make any limitations to the present invention. Those skilled in the art will appreciate that various variations and modifications are possible, without departing from the sprit and scope of the present invention. In view of the foregoing, it is intended that the present invention covers modifications and variations of this invention provided they fall within the scope of the following claims and their equivalents.

What is claimed is:

1. A dustproof cover which is installed in a connector, the connector comprising:

a connector body, the connector body having a substantially cubic shape receiving space, and the receiving space including a bottom side, an opposite top side, a rear side, and two lateral sides, the connector body having an opening at a front surface of the receiving space and adapted for the insertion of a signal line plug, wherein the two lateral sides each have a recess near ajunction of the opening and the top side;

at least a terminal located on the bottom side of the receiving space; and the dustproof cover, installed at the opening of the receiving space, comprising:

a U-shaped body, includes a bottom plate and two lateral plates, the concave side of the U-shaped body forming a slot adapted for sliding movement of the signal line plug within;

two extension plates, respectively located along edges of the two lateral plates and extended away from the U-shaped body, with the extension plate and the lateral plate forms a L-shaped structure;

two extruded pivots, pointing away from the U-shaped body, and respectively located on the two lateral plates near one end of the U-shaped body, to be secured in the two recesses of the connector body, so that the dustproof cover can rotate between the top side of the connector body and the opening by use of the two extruded pivots;

two protrusions, located on the concave side of the U-shaped body, and respectively at junctions between the bottom plate and the two lateral plates, whereby the signal line plug is buckled; and at least a spring located between the top side of the connector body and the two extension plates, by which a moment is applied to the dustproof cover so that the dustproof cover is urged to rotate toward the opening of the connector body.

2. The dustproof cover according to claim 1, wherein the dustproof cover is located at the opening of the connector body when no signal line plug is inserted, in order to shield the opening, under which conditions the slot of the dustproof cover faces outward from the opening.

3. The dustproof cover according to claim 1, wherein the slot of the dustproof cover is parallel to the top side of the connector body when the signal line plug is inserted, and the two protrusions buckle the signal line plug.

4. The dustproof cover according to claim 1, wherein the connector is adapted for installation in a layout panel.

5. The dustproof cover according to claim 1, wherein the signal line plug includes a RJ-45 plug.

6. The dustproof cover according to claim 1, wherein the signal line plug includes a RJ-11 plug.

7. The dustproof cover according to claim 1, wherein the connector includes a twisted pair connector.

* * * * *